US007928947B2

(12) United States Patent
Cho et al.

(10) Patent No.: US 7,928,947 B2
(45) Date of Patent: Apr. 19, 2011

(54) LIQUID CRYSTAL DISPLAY DEVICE AND METHOD OF DRIVING THE SAME

(75) Inventors: Hyung Nyuck Cho, Incheon-si (KR); Soo Young Yoon, Goyang-si (KR); Min Doo Chun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 719 days.

(21) Appl. No.: 12/005,614

(22) Filed: Dec. 28, 2007

(65) Prior Publication Data

US 2008/0231769 A1 Sep. 25, 2008

(30) Foreign Application Priority Data

Mar. 20, 2007 (KR) ..... 10-2007-0027127

(51) Int. Cl.
*G09G 3/36* (2006.01)

(52) U.S. Cl. ..... 345/93; 345/99

(58) Field of Classification Search ..... 345/87, 345/90, 92, 93, 95, 96, 98–100, 204, 208–210
See application file for complete search history.

(56) References Cited

U.S. PATENT DOCUMENTS

| | | | | |
|---|---|---|---|---|
| 6,795,049 | B2 * | 9/2004 | Toyoshima et al. | 345/93 |
| 7,593,069 | B2 * | 9/2009 | Oh et al. | 349/43 |
| 2004/0246246 | A1 * | 12/2004 | Tobita | 345/205 |
| 2004/0263453 | A1 * | 12/2004 | Yun et al. | 345/87 |
| 2006/0041805 | A1 * | 2/2006 | Song | 714/724 |

FOREIGN PATENT DOCUMENTS

| | | |
|---|---|---|
| CN | 1340728 | 3/2002 |
| JP | 8-248385 | 9/1996 |

* cited by examiner

*Primary Examiner* — Ricardo L Osorio
(74) *Attorney, Agent, or Firm* — McKenna Long & Aldridge LLP

(57) ABSTRACT

A liquid crystal display device and a method of driving the same is disclosed. The liquid crystal display device includes a liquid crystal panel including a liquid crystal panel including a plurality of first and second pixel cells supplied with data of the opposite polarities to display a picture, and a pre-charging unit to electrically connect a first one of the first pixel cells and a first one of the second pixel cells to each other just prior to a period of supplying the data to the first ones first and second pixel cells, and to electrically disconnect the first ones of the first and second pixel cells from each other for a period of supplying the data to the first and second pixel cells.

3 Claims, 6 Drawing Sheets

LIQUID CRYSTAL DISPLAY DEVICE AND METHOD OF DRIVING THE SAME

This application claims the benefit of Korean Patent Application No. P2007-27127 filed Mar. 20, 2007, which is hereby incorporated by reference for all purposes as if fully set forth herein.

BACKGROUND OF THE INVENTION

1. Field of the Invention

The present invention relates to a liquid crystal display device, and more particularly, to a liquid crystal display device which can improve the charging of pixel cells of the display device, and a method of driving the same.

2. Discussion of the Related Art

In general, a liquid crystal display device displays desired images by controlling light transmittance of liquid crystal cells in response to a video signal. Active-matrix type liquid crystal display devices are particularly well suited for displaying moving picture because a switching element is provided in each liquid crystal pixel cell. In an active-matrix type liquid crystal display device, a thin film transistor (hereinafter, referred to as a "TFT") is used as the switching element.

A liquid crystal display device includes a plurality of gate and data lines that cross each other to thereby define the plurality of liquid crystal pixel cells. To prevent deterioration of the liquid crystal, the data voltages applied to each pixel cell alternate in polarity.

FIG. 1 is a waveform diagram illustrating the polarity of data applied to pixel cells in a dot-inversion driving method. As shown in FIG. 1, the polarity of data is inverted for each frame period, and the inverted polarity data is supplied to each data line. The data supplied to each pixel cell for a frame period is maintained by the pixel cell until data is supplied for the next frame to thereby display a picture image for one frame period.

As shown in FIG. 1, the polarity of data supplied to a pixel cell is inverted on a frame period basis. That is, the data applied to a pixel cell is inverted from the positive polarity to the negative polarity or from the negative polarity to the positive polarity every frame period.

However, when the polarity of data is inverted every frame period, the charging of pixel cells to target values for displaying an image deteriorates, thereby degrading the picture quality. For example, assuming that a pixel cell was supplied with data of positive polarity during a previous period, and is supplied with the data of negative polarity during the current period, it can be difficult to charge the pixel cell sufficiently rapidly to the reach the desired value represented by the data of negative polarity from the positive polarity data supplied to the pixel cell during the previous period.

SUMMARY OF THE INVENTION

Accordingly, the present invention is directed to a liquid crystal display device and a method of driving the same that substantially obviates one or more problems due to limitations and disadvantages of the related art.

An advantage of the present invention is to provide a liquid crystal display device and a method of driving the same, in which pixel cells supplied with data of the opposite polarities are pre-charged by the electric connection before a display period, thereby improving the charging of pixel cells.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the invention, as embodied and broadly described herein, a liquid crystal display device includes a liquid crystal panel that includes a plurality of first and second pixel cells supplied with data of the opposite polarities to display a picture; and a pre-charging unit to electrically connect a first one of the first pixel cells and a first one of the second pixel cells to each other just prior to a period of supplying the data to the first ones first and second pixel cells, and to electrically disconnect the first ones of the first and second pixel cells from each other for a period of supplying the data to the first and second pixel cells.

In another aspect of the present invention, a method of driving a liquid crystal display device including a liquid crystal panel having a plurality of first and second pixel cells supplied with data of the opposite polarities to display a picture, includes: electrically connecting the first and second pixel cells to each other to supply the data of the second pixel to the first pixel, and supply the data of the first pixel to the second pixel; electrically disconnecting the first and second pixel cells from each other; and supplying the data of the opposite polarities to the first and second pixel cells, respectively.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, a liquid crystal display device according to embodiments of the present invention and a method of driving the same will be explained with reference to the accompanying drawings.

Figure 1:
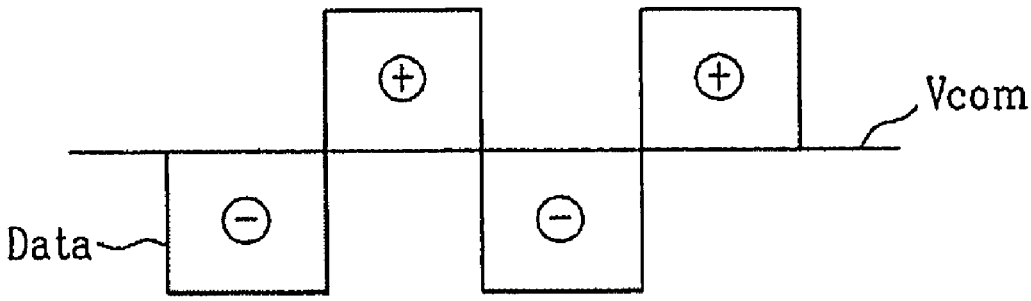
FIG. 1 Related Art
FIG. 1 is a waveform diagram illustrating the polarity of data in a dot-inversion driving method.
Figure 2:
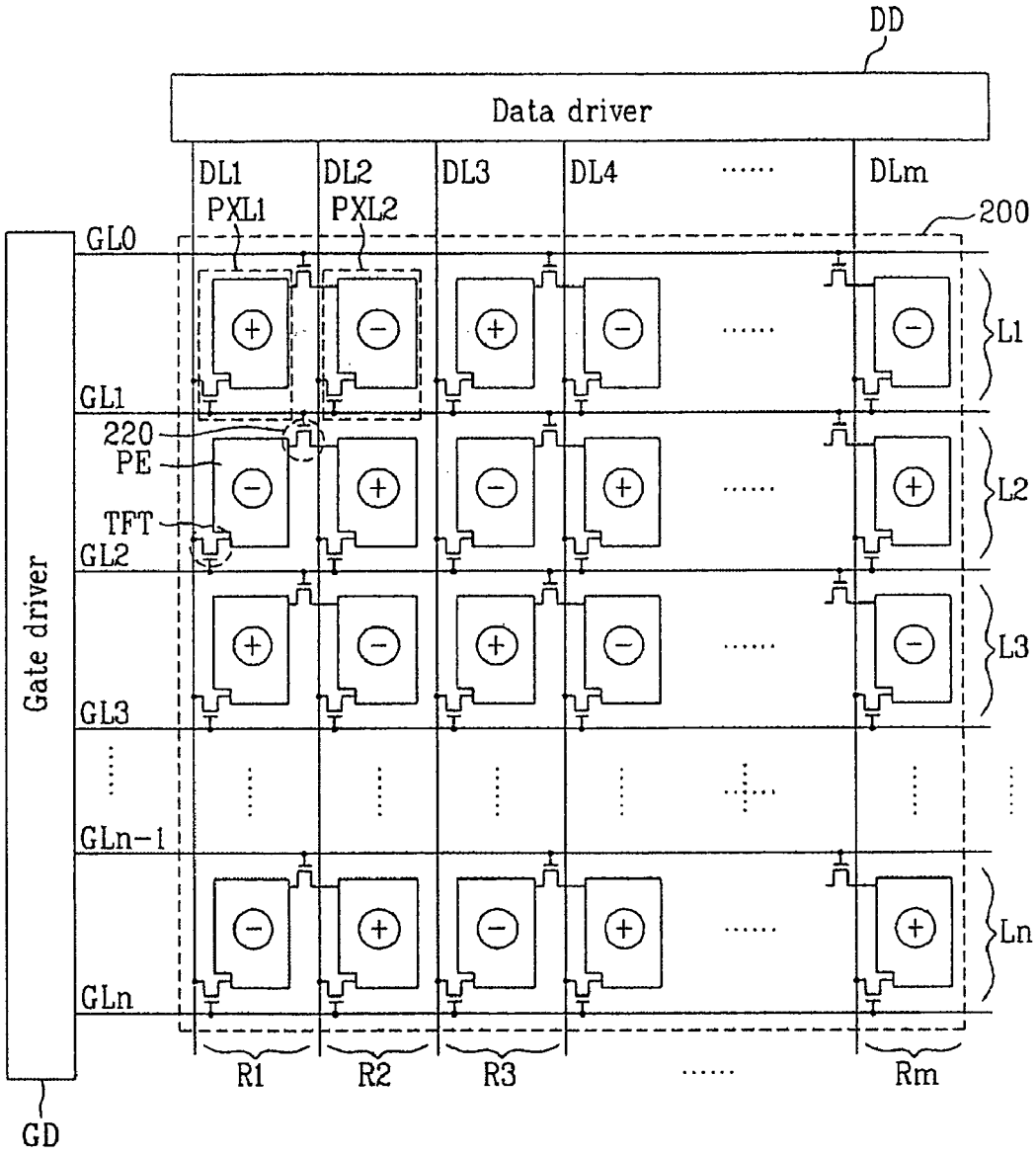
FIG. 2 is a schematic diagram illustrating an LCD device according to a first embodiment of the present invention.
Figure 3:
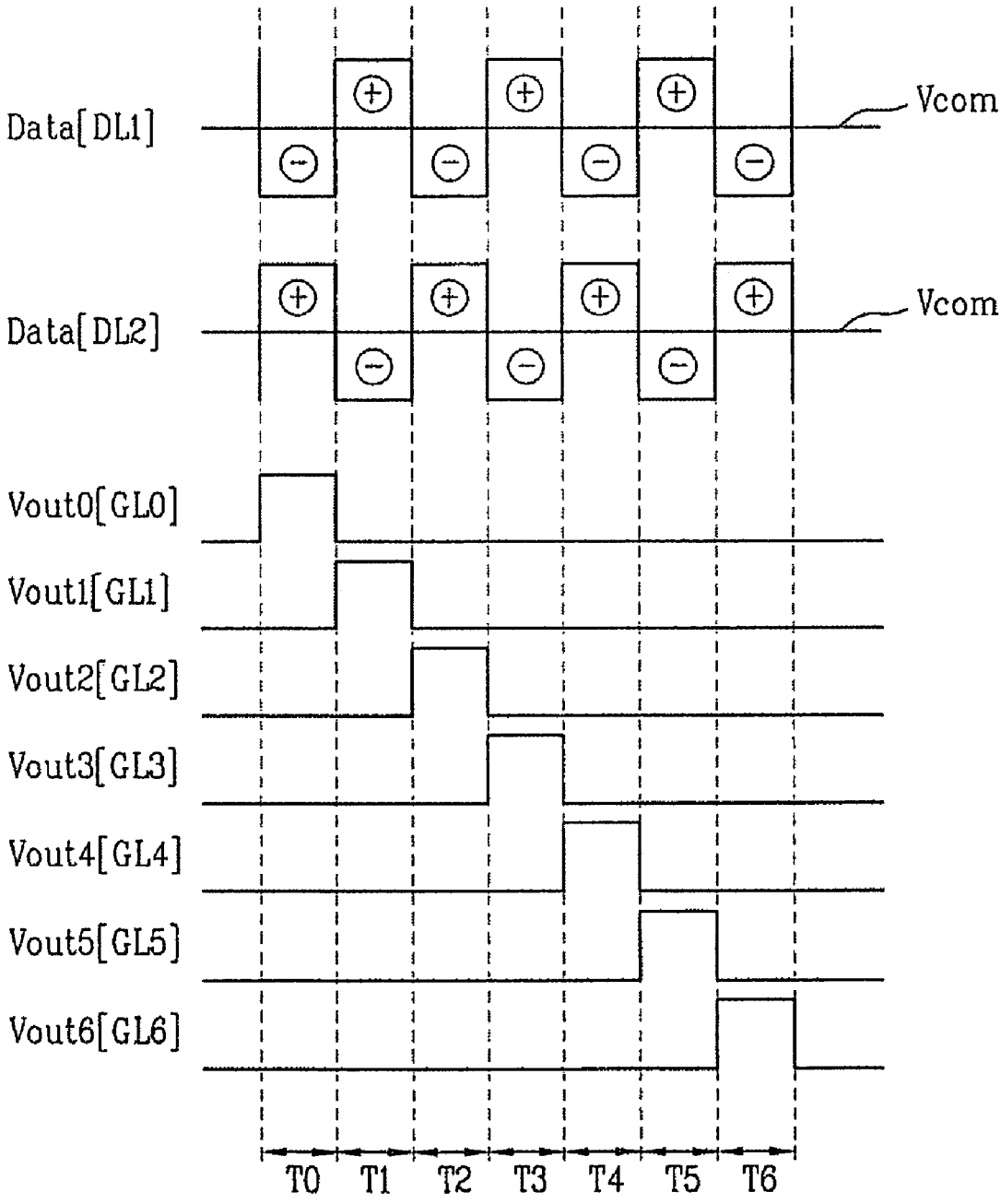
FIG. 3 is a timing diagram illustrating various signals supplied to gate and data lines of the LCD device shown in FIG. 2.

FIG. 2 is a schematic diagram illustrating an LCD device according to a first embodiment of the present invention. FIG. 3 is a timing diagram illustrating various signals supplied to gate and data lines of the LCD device shown in FIG. 2.

As shown in FIG. 2, the LCD device according to the first embodiment of the present invention includes a liquid crystal panel 200 provided with a plurality of first and second pixel cells PXL1 and PXL2 to display images; and a gate driver GD and a data driver DD to drive the liquid crystal panel 200.

The first pixel cells PXL1 are supplied with data of the same polarity, to thereby display images. The polarity of data supplied to the first pixel cells PXL1 is opposite to the polarity of data supplied to the second pixel cells PXL2. For example, as shown in FIG. 2, the pixel cells supplied with positive polarity data correspond to the first pixel cells PXL1, and the pixel cells supplied with negative polarity data correspond to the second pixel cells PXL2. The liquid crystal panel 200 includes a plurality of gate lines GL1 to GLn that cross a plurality of data lines DL1 to DLm, wherein the gate lines GL are orthogonal or substantially perpendicular to the data lines DL.

The gate driver GD outputs scan pulses Vout0 to Voutn for driving the gate lines GL1 to GLn in sequence, and the data driver DD supplies data to the data lines DL1 to DLm. The data driver DD is supplied with data for one line (i.e., the data to be supplied to the pixel cells arranged along one pixel row) for each horizontal period by a timing controller, and selects a gray scale voltage previously set to the data for corresponding one line. The gray scale voltages for the selected one line are supplied to the data lines DL1 to DLm, respectively.

For convenience of the explanation, the gray scale voltages supplied to the respective data lines DL1 to DLm are referred to collectively as the data.

In each of the pixel columns R1 to Rm, positioned at the right side of a corresponding one of the data lines DL1 to DLm, there are a plurality of pixel cells PXL1 and PXL2 arranged along the data line direction. The pixel cells PXL1 and PXL2 included in each pixel column R1 to Rm are connected to the data line positioned at the left side thereof in common, and the pixel cells included in each of the pixel columns R1 to Rm are connected to a respective one of the first to nth gate lines GL1 to GLn. For example, the first and second pixel cells PXL1 and PXL2 included in the first pixel column R1 are each connected to the first data line DL1, and are each connected to a respective one of the first to nth gate lines GL1 to GLn.

The pixel cells connected to the (3k+1)th data line correspond to the pixel cells for displaying a red picture; the pixel cells connected to the (3k+2)th data line correspond to the pixel cells for displaying a green picture; and the pixel cells connected to the (3k+3)th data line correspond to the pixel cells for displaying a blue picture, where k is an integer.

Each pixel cell includes a thin film transistor TFT that turns on to supply the data from the data line DL to the pixel cell in response to the scan pulse from the gate line GL; a pixel electrode PE that is supplied with the data from the thin film transistor TFT; a common electrode that is positioned opposite the pixel electrode PE; and a liquid crystal layer that is positioned between the pixel electrode PE and the common electrode. Light transmittance through each pixel cell varies in response to an electric field generated between the pixel electrode PE and the common electrode.

Adjacent pixel cells in the horizontal or vertical direction are supplied with the data of different polarities, with the polarity alternating by units of one pixel cell. To generate the alternating polarity, the data driver DD alternately supplies positive polarity data and negative polarity data to the data lines DL1 to DLm, with the supplied data polarity alternating every frame period. Further, the data driver DD supplies data of opposite polarities to adjacent data lines. In other words, the data driver DD outputs the data according to a one-dot inversion method.

The first pixel cell PXL1 and the second pixel cell PXL2 are supplied with different polarities during a single frame period. For example, the first pixel cell PXL1 may be supplied with positive polarity data for the odd-numbered frame periods and with negative polarity data for the even-numbered frame periods, while the second pixel cell PXL2 is supplied with negative polarity data for the odd-numbered frame periods and with the positive polarity data for the even-numbered frame periods.

The positive polarity data corresponds to data that has a higher voltage level than the common voltage Vcom, while the negative polarity data corresponds to data that has a lower voltage level than the common voltage Vcom.

In each pixel row L1 to Ln, the first and second pixel cells PXL1 and PXL2 are arranged alternately. In the example embodiment illustrated in FIG. 2, the first pixel cell PXL1 is positioned at the leftmost side of the odd-numbered pixel rows L1, L3, . . . , Ln−1; and the second pixel cell PXL2 is positioned at the leftmost side of the even-numbered pixel rows L2, L4, . . . , Ln. In other words, the odd-numbered pixel rows L1, L3, . . . , Ln−1 are provided with pixel cells arranged in an alternating sequence having a first pixel cell PXL1 followed by a second pixel cell PXL2; and the even-numbered pixel rows L2, L4, . . . , Ln are provided with the pixel cells arranged in an alternating sequence having a second pixel cell PXL2 followed by a first pixel cell PXL1.

The first and second pixel cells PXL1 and PXL2 positioned adjacent to each other and connected to the same gate line are provided with a pre-charging unit 220 that electrically connects together or disconnects from each other, the first and second pixel cells PXL1 and PXL2 depending on the state of the pre-charging unit 220. For example, the first pixel cell PXL1 connected to the first gate line GL1 and the first data line DL1 is electrically connected together with or disconnected from the adjacent second pixel cell PXL2 connected to the first gate line GL1 and the second data line DL2 by a pre-charging unit 220. In other words, the pre-charging unit 220 corresponds to a switching device that electrically connects the pixel electrode PE of the first pixel cell PXL1 and the pixel electrode PE of the second pixel cell PXL2 in response to the scan pulse from the gate line. To accomplish the electrical connection in response to the scan pulse, the pre-charging unit 220 includes a gate terminal connected to the gate line; a source terminal connected to the pixel electrode PE of the first pixel cell PXL1; and a drain terminal connected to the pixel electrode PE of the second pixel cell PXL2.

The pre-charging unit 220 is turned-off during a display period for supplying data to the first and second pixel cells PXL1 and PXL2, so that the first pixel cell PXL1 is electrically disconnected from the second pixel cell PXL2. That is, the pre-charging unit 220 is turned-off for the display period of the first and second pixel cells PXL1 and PXL2, so that the pixel electrode PE of the first pixel cell PXL1 is electrically disconnected from the pixel electrode PE of the second pixel cell PXL2. For this display period, the data of the first pixel cell PXL1 does not interfered with the data of the second pixel cell PXL2.

However, the pre-charging unit 220 electrically connects the first and second pixel cells PXL1 and PXL2 during a previous period just prior to the display period for the first and second pixel cells PXL1 and PXL2. Accordingly, the data of the first pixel cell PXL1 and the data of the second pixel cell PXL2 will affect each other during this previous period. The previous period just prior to the display period corresponds to a display period for driving the pixel cells prior to driving the first and second pixel cells PXL1 and PXL2.

More generally, each pre-charging unit 220 positioned at the (k)th pixel row electrically connects the pixel electrode PE of a first pixel cell PXL1 connected to the (k)th gate line to the pixel electrode PE of an adjacent second pixel cell PXL2 in response to the (k−1)th scan pulse from the (k−1)th gate line. That is, during the display period of the pixel cells connected to the (k−1)th gate line, the pre-charging unit 220 of the (k)th pixel row electrically connects the pixel electrode PE of the first pixel cell PXL1 connected to the (k)th gate line to the pixel electrode PE of the second pixel cell PXL2 connected to the (k)th gate line.

For example, the pre-charging units 220 positioned at the second pixel row L2, include the pre-charging unit 220 connected between a second pixel cell PXL2 connected to the second gate line GL2 and the first data line DL1 and the first pixel cell PXL1 connected to the second gate line GL2 and the second data line DL2. The pre-charging units 220 for the second pixel row L2 are controlled by the first scan pulse Vout1 from the first gate line GL1 that is positioned just prior to the second gate line GL2. For the period of sustaining the first scan pulse Vout1 as an active state (high state), the pre-charging unit 220 electrically connects the pixel electrode PE of the first pixel cell PXL1 to the pixel electrode PE of the second pixel cell PXL2. The pre-charging unit 220 positioned at the second pixel row is maintained in a turned-off state except during the period of sustaining the first scan pulse Vout1 as the active state.

A dummy gate line GL0 is positioned at an upper side of the first gate line GL1. The dummy gate line GL0 is connected to the gate terminal of the pre-charging unit 220 to control a connection relation between the first and second pixel cells PXL1 and PXL2 connected to the first gate line GL1. That is, the dummy gate line GL0 is provided for supplying a signal to control the pre-charging unit 220 positioned at the first pixel row L1. The dummy gate line GL0 is supplied with a dummy scan pulse Vout0, wherein the dummy scan pulse Vout0 is supplied first among the scan pulses output in each frame period. Accordingly, the dummy gate line GL0 is driven first in each frame period.

The thin film transistor TFT included in each pixel cell PXL1 and PXL2 is turned-on for 1H period (display period) that may be about 10% of one frame period, and is turned-off for remaining portion of the frame period (sustaining period) that may be about 90% of one frame period. After the pre-charging unit 220 is supplied with the corresponding data for the display period, the pre-charging unit 220 renews the previous data and sustains the supplied data for the sustaining period.

For the period just prior to the display period of supplying the data to the first and second pixel cells PXL1 and PXL2, the pre-charging unit 220 is turned on and shifts the polarity of data previously charged in the first and second pixel cells PXL1 and PXL2 towards the polarity direction of data to be supplied to the first and second pixel cells PXL1 and PXL2 for the display period. Thus, it is possible to induce the polarity of data charged in the first and second pixel cells PXL1 and PXL2 to change towards the polarity direction of data to be supplied for the display period. An operation of the pre-charging unit 220 to control the first and second pixel cells PXL1 and PXL2 of the third pixel row L3 and the connection relation between the first and second pixel cells PXL1 and PXL2 will be explained in detail as follows.

The pre-charging unit 220 positioned at the leftmost side of the third pixel row L3 is connected between the first pixel cell PXL1 connected to the third gate line GL3 and the first data line DL1 and the second pixel cell PXL2 connected to the third gate line GL3 and the second data line DL2.

As shown in FIGS. 2 and 3, the first pixel cell PXL1 may be supplied with the positive polarity data for the third period T3, while the second pixel cell PXL2 is supplied with the negative polarity data for the third period T3, to thereby display the picture. That is, the third period T3 corresponds to the display period of the first and second pixel cells PXL1 and PXL2. For the previous period prior to the display period, the first pixel cell PXL1 sustains the negative polarity data supplied from the previous frame period, and the second pixel cell PXL2 sustains the positive polarity data supplied from the previous frame period. In other words, the data of the first pixel cell PXL1 for the third period T3 transitions from the negative polarity to the positive polarity, and the data of the second pixel cell PXL2 transitions from the positive polarity to the negative polarity.

During the second period T2 that is just prior to the third period, the second scan pulse Vout2 is supplied to the second gate line GL2. In response to the second scan pulse, the pre-charging unit 220 is turned-on. As a result of the pre-charging unit 220 being turned-on, the pixel electrode PE of the first pixel cell PXL1 is electrically connected to the pixel electrode PE of the second pixel cell PXL2.

For the second period T2, the negative polarity data of the first pixel cell PXL1 is mixed with the positive polarity data of the second pixel cell PXL2. For the second period T2, the first pixel cell PXL1 is sustained with the negative polarity data, and the second pixel cell PXL2 is sustained with the positive polarity data. Accordingly, by turning on the pre-charge unit 220, the positive polarity data of the second pixel cell PXL2 is affected by the negative polarity data of the first pixel cell PXL1, and the negative polarity data of the first pixel cell PXL1 is affected by the positive polarity data of the second pixel cell PXL2.

When the first and second pixel cells PXL1 and PXL2 are charged with the opposite polarities, and are electrically connected to each other, the data of each pixel cell PXL1 and PLX2 rises or falls toward the central or voltage corresponding to the common voltage Vcom. For example, the negative polarity data charged in the first pixel cell PXL1 is affected by the positive polarity data from the second pixel cell PXL2, so that the voltage rises toward the common voltage. Meanwhile, the positive polarity data charged in the second pixel cell PXL2 is affected by the negative polarity data from the first pixel cell PXL1, so that the voltage falls toward the common voltage Vcom.

For the third period T3, the third gate line GL3 is supplied with the scan pulse Vout3, and the second gate line GL2 is not supplied with the scan pulse Vout2. Accordingly, the pre-charging unit 220 is turned-off for the third period T3, and the first pixel cell PXL1 is electrically disconnected from the second pixel cell PXL2.

The third period T3 corresponds to the display period of the first and second pixel cells PXL1 and PXL2 connected to the third gate line GL3. For the third period T3, the positive polarity data is supplied to the first data line DL1, and the negative polarity data is supplied to the second data line DL2. Accordingly, the first pixel cell PXL1 is supplied with the positive polarity data, and the second pixel cell PXL2 is supplied with the negative polarity data.

Because the negative polarity data charged in the first pixel cell PXL1 has previously risen towards the common voltage Vcom for the second period T2, the negative polarity data charged in the first pixel cell PXL1 is more rapidly changed to the target value of the positive polarity data supplied for the third period T3 than would occur without operation of the pre-charge unit 220. Further, since the positive polarity data charged in the second pixel cell PXL2 previously has fallen toward the common voltage Vcom for the second period T2, the positive polarity data charged in the second pixel cell PXL2 is more rapidly changed to the target value of the negative polarity data supplied for the third period T3.

Figure 4:
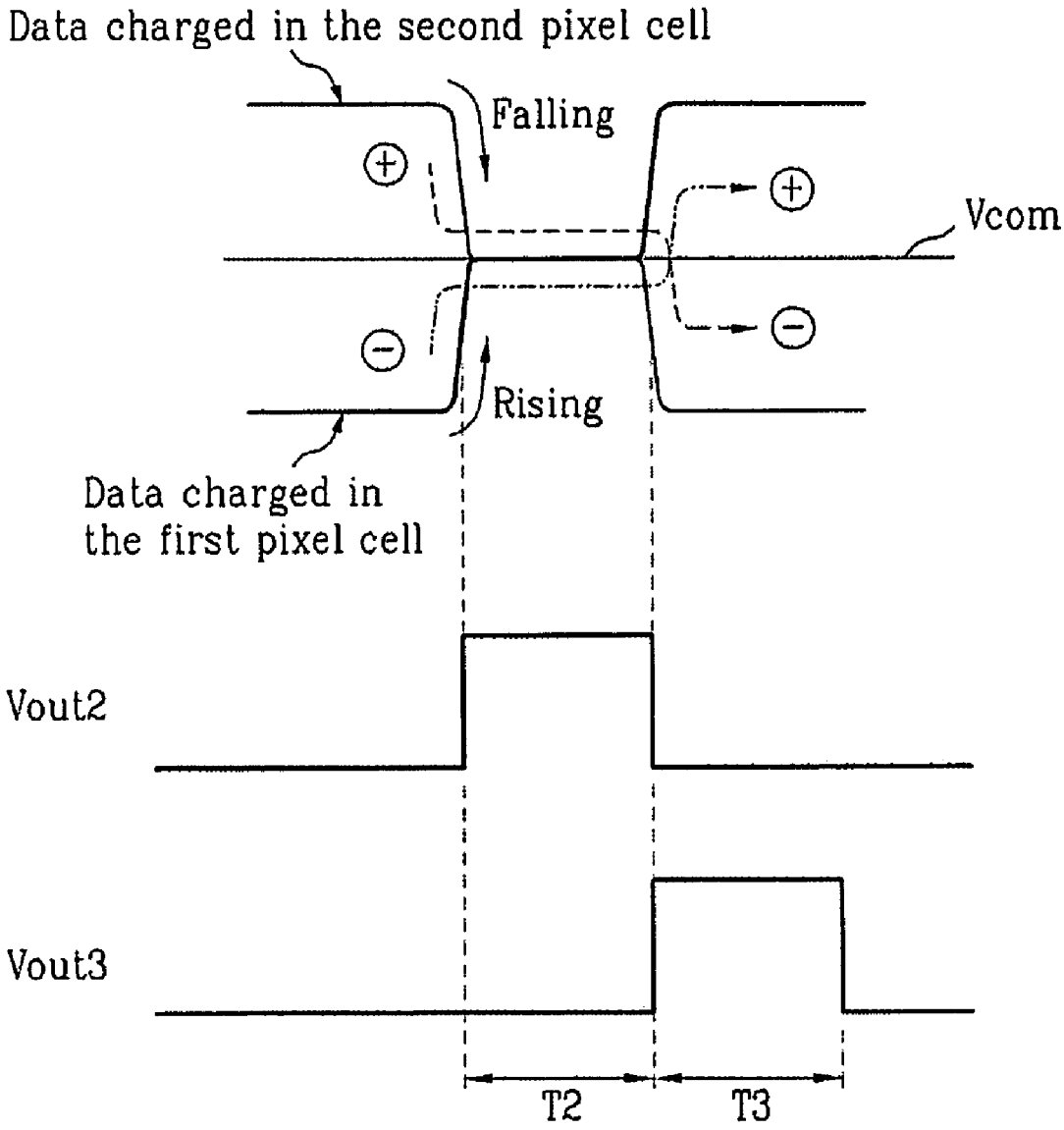
FIG. 4 is a diagram illustrating charging amounts for first and second pixel cells of the LCD device shown in FIG. 2.

FIG. 4 is a diagram illustrating charging amounts for first and second pixel cells of the LCD device shown in FIG. 2. As shown in FIG. 4, the negative polarity data sustained in the first pixel cell prior to the second period T2 rises toward the common voltage Vcom at the second period T2, and is changed to the positive polarity data at the third period T3 corresponding to the display period. Additionally, the positive polarity data sustained in the second pixel cell PXL2 prior to the second period T2 falls toward the common voltage Vcom at the second period T2, and is changed to the negative polarity data at the display period corresponding to the third period T3.

Figure 5:
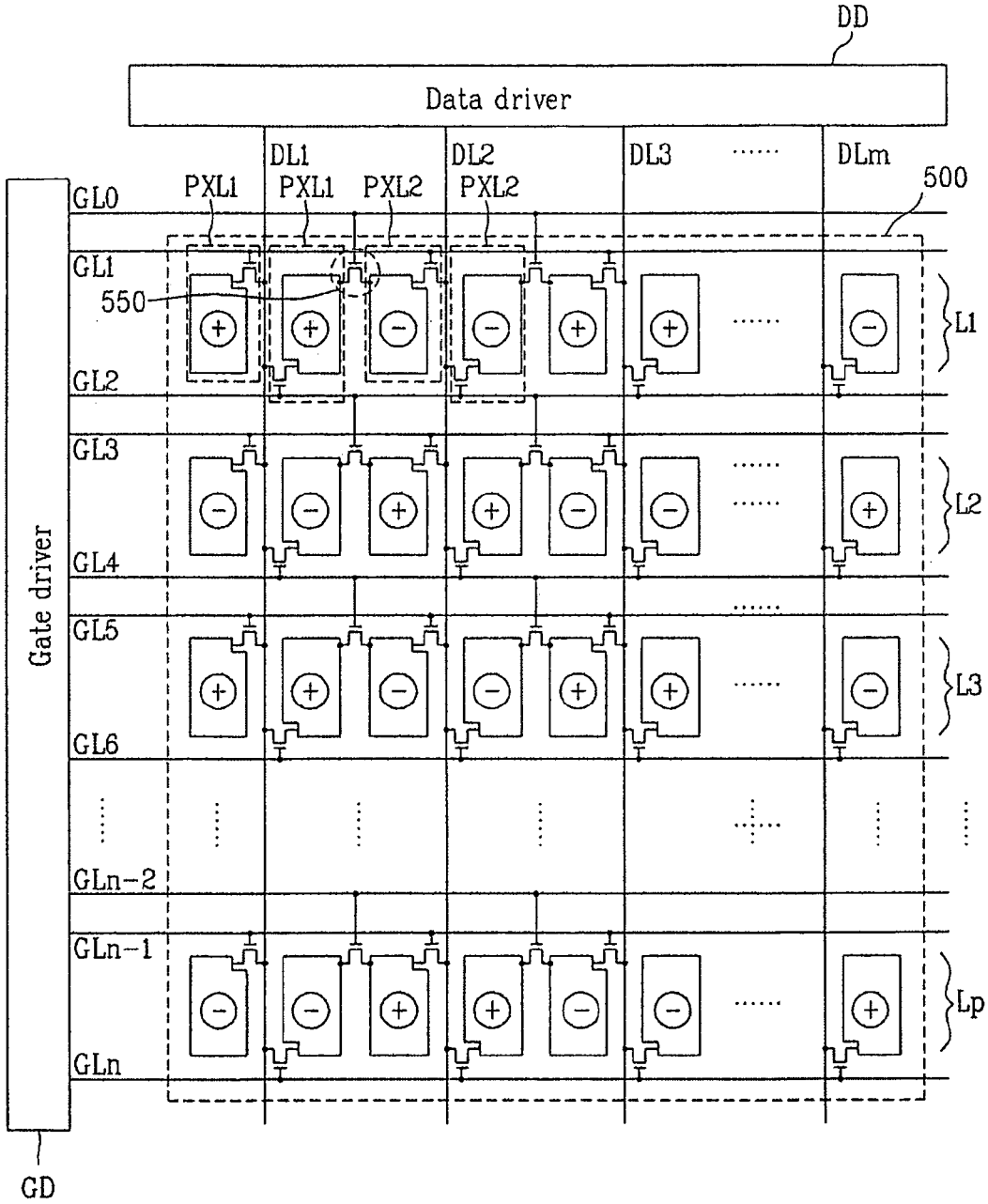
FIG. 5 is a schematic diagram illustrating an LCD device according to a second embodiment of the present invention.
Figure 6:
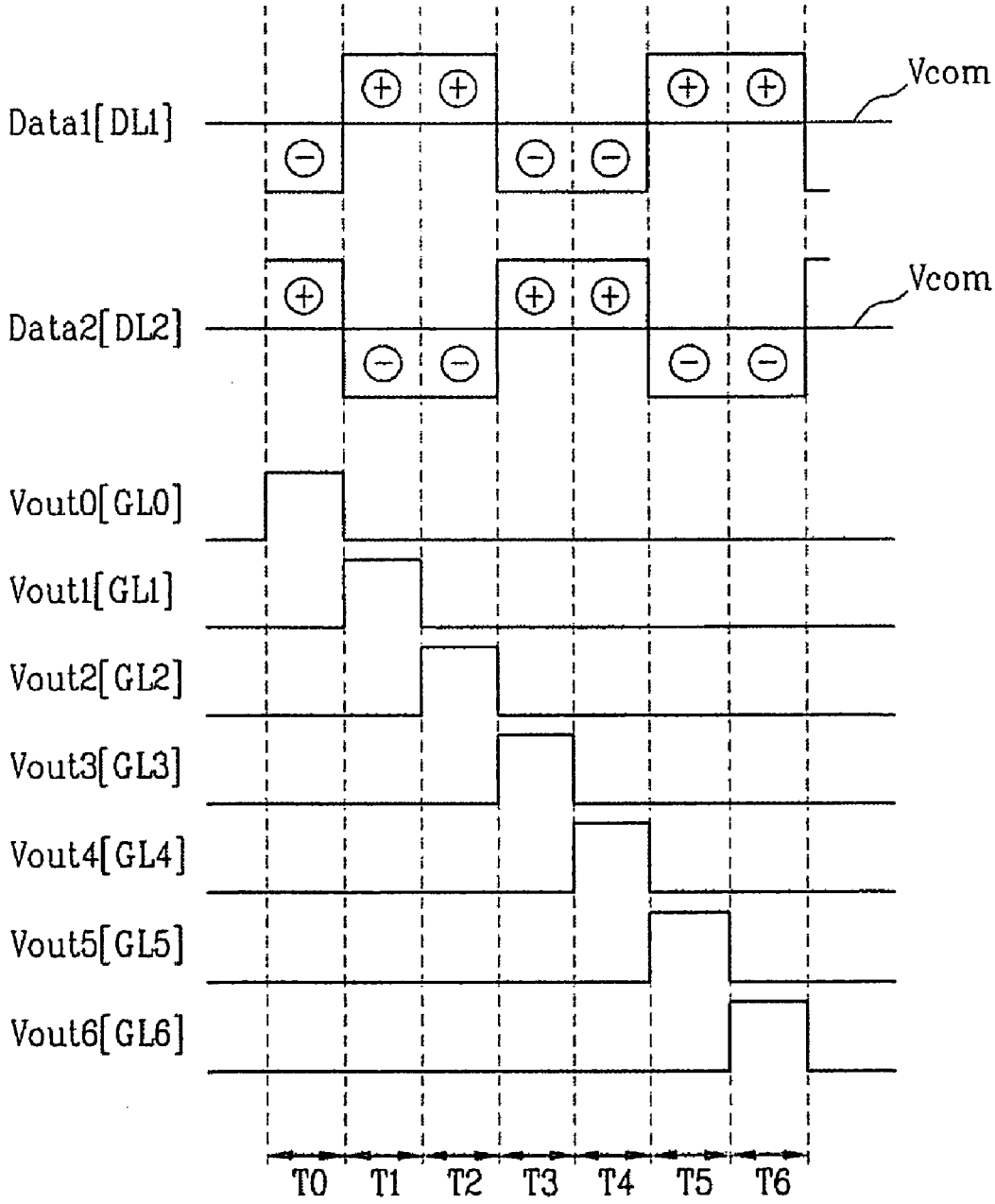
FIG. 6 is a timing diagram illustrating various signals supplied to gate and data lines of the LCD device shown in FIG. 5.

FIG. 5 is a schematic diagram illustrating an LCD device according to a second embodiment of the present invention. FIG. 6 is a timing diagram illustrating various signals supplied to gate and data lines of the LCD device shown in FIG. 5.

As shown in FIG. 5, pixels arranged adjacently in a vertical direction (i.e. vertically adjacent pixels) are supplied with data of the different polarities alternating every one pixel cell, and pixel cells arranged adjacently in a horizontal direction (i.e. horizontally adjacent pixels) are supplied with data of the different polarities, alternating every two pixel cells, to thereby display a picture. To accomplish the above described polarity scheme, as shown in FIGS. 5 and 6, a data driver DD supplies alternately the positive polarity data and the negative polarity data to data lines DL1 to DLm, with the data supplied to each data line alternating every two periods. In addition, the adjacent data lines are supplied with the data of the opposite polarities. That is, the data driver DD outputs the data according to a 2-dot inversion method.

The pixel cells include the first pixel cells PXL1 and the second pixel cells PXL2. In each frame period, the polarity of a first pixel cell PXL1 is different from the polarity of a second pixel cell PXL2. For example, the first pixel cell PXL1 may be supplied with the positive polarity data for the odd-numbered frame periods and with the negative polarity data for the even-numbered frame periods. Meanwhile, the second pixel cell PXL2 is supplied with the negative polarity data for the odd-numbered frame periods and with the positive polarity data for the even-numbered frame periods.

As shown in FIG. 5, with reference to each of the data lines DL1 to DLm, adjacent pairs of pixel cells of the same polarity are positioned opposite to each other, and are connected to a common data line positioned therebetween.

For the pixel rows L1 to Lp, first pixel cells PXL1 and the second pixel cells PXL2 alternate as the starting pixel for the pixel row. In the example pictured in FIG. 5, a first pixel cell PXL1 is positioned at the leftmost side of the odd-numbered pixel rows L1, L3, . . . , Lp−1; and a second pixel cell PXL2 is positioned at the leftmost side of the even-numbered pixel row L2, L4, . . . , Lp. Additionally, each odd-numbered pixel row L1, L3, . . . , Lp−1 is provided with the pixel cells arranged in a repeating sequence order of a first pixel cell PXL1, another first pixel cell PXL1, a second pixel cell PXL2 and another second pixel cell PXL2, while each even-numbered pixel row L2, L4, . . . , Lp is provided with the pixel cells arranged in a repeating sequence order of a second pixel cell PXL2, another second pixel cell PXL2, a first pixel cell PXL1 and another first pixel cell PXL1.

A gate line is positioned at each of the lower and upper sides of each pixel row L1 to Ln. The odd-numbered pixel cells PXL1 and PXL2 included in each pixel row L1 to Lp are connected to the gate line positioned at the upper side of each pixel row L1 to Ln in common; and the even-numbered pixel cells PXL1 and PXL2 included in each pixel row L1 to Lp are connected to the gate line positioned at the lower side of each pixel row L1 to Ln in common. For example, the odd-numbered pixel cells among the pixel cells PXL1 and PXL2 included in the first pixel row L1 are connected to the first gate line GL1 in common, while the even-numbered pixel cells are connected to the second gate line GL2 in common. In addition, the gate line positioned at the lower side of each pixel row L1 to Lp is connected to a pre-charging unit 550 for the next pixel row.

Adjacently positioned first and second pixel cells PXL1 and PXL2 that are provided in the same pixel row and that are connected to different gate lines, are electrically connected to and disconnected from each other by a pre-charging unit 550. For example, the first gate line GL1 is provided at the upper side of the first pixel row L1, and the second gate line GL2 is provided at the lower side of the first pixel row L1. One pre-charging unit 550 included in the first pixel row L1 electrically connects the first pixel cell PXL1 connected to the second gate line GL2 and the first data line DL1 to the adjacent second pixel cell PXL2 connected to the first gate line GL1 and the second data line DL2, and electrically disconnects the first pixel cell PXL1 connected to the second gate line GL2 and the first data line DL1 from the adjacent second pixel cell PXL2 connected to the first gate line GL1 and the second data line DL2.

Alternatively, the pre-charging unit 550 may be connected to adjacent first and second pixel cells PXL1 and PXL2 positioned in the same pixel row and connected to different data lines. For example, the pre-charging unit 550 positioned in the first pixel row L1 may be connected between the first pixel cell PXL1 (positioned in the first pixel row L1 and connected to the first data line DL1 and the second gate line GL2) and the second pixel cell PXL2 (positioned in the first pixel row L1 and connected to the second data line DL2 and the second gate line GL2).

The pre-charging unit 550 included in a pixel row is turned-off for the display period of supplying the data to the first and second pixel cells PXL1 and PXL2 included in the corresponding pixel row to thereby electrically disconnect the first pixel cell PXL1 from the second pixel cell PXL2. That is, the pre-charging unit 550 is turned-off for the display period of the first and second pixel cells PXL1 and PXL2, so that the pixel electrode PE of the first pixel cell PXL1 is electrically disconnected from the pixel electrode PE of the second pixel cell PXL2. Accordingly, for this display period, the data of the first pixel cell PXL1 does not interfere with the data of the second pixel cell PXL2.

On the other hand, the pre-charging unit 550 electrically connects the first and second pixel cells PXL1 and PXL2 to each other for a previous period just prior to the display period of the first and second pixel cells PXL1 and PXL2. Thus, the data of the first pixel cell PXL1 and the data of the second pixel cell PXL2 affect each other during the prior period. The previous period just prior to the display period corresponds to a display period for the pixel cells previously driven prior to driving the first and second pixel cells PXL1 and PXL2.

More generally, the pre-charging unit 550 positioned in the (k)th pixel row electrically connects two first and second pixel cells PXL1 and PXL2 to each other in response to the scan pulse from the gate line positioned at the lower side of the (k−1)th pixel row. In other words, for the period of turning-on the odd-numbered pixel cells (or even-numbered pixel cells) included in the (k−1)th pixel row, the pre-charging unit 220 included in the (k)th pixel row electrically connects the pixel electrode PE of the first pixel cell PXL1 included in the (k)th pixel row to the pixel electrode PE of the second pixel cell PXL2 included in the (k)th pixel row.

For example, in case of the pre-charging unit 550 included in the second pixel row L2, the pre-charging unit 550 is connected between the first pixel cell PXL1 connected to the third gate line GL3 and the second data line DL2, and the second pixel cell PXL2 connected to the fourth gate line GL4 and the first data line DL1. The pre-charging unit 550 is controlled by the second scan pulse Vout2 from the second gate line GL2 that is positioned at the lower side of the first pixel row L1, that is, the pixel row positioned just prior to the second pixel row L2. For the period of sustaining the second scan pulse Vout2 as an active state (high state), the pre-charging unit 550 electrically connects the pixel electrode PE of the first pixel cell PXL1 to the pixel electrode PE of the second pixel cell PXL2. The pre-charging unit 550 positioned at the second pixel row L2 is sustained in a turning-off state except the period of sustaining the second scan pulse Vout2 as the active state.

A dummy gate line GL0 is positioned at an upper side of the first gate line GL1. The dummy gate line GL0 is connected to the gate terminal of the pre-charging unit 550 to control a connection relation between the first and second pixel cells PXL1 and PXL2 positioned in the first pixel row L1. That is, the dummy gate line GL0 is provided for supplying a signal to control the pre-charging unit 550 positioned at the first pixel row L1. The dummy gate line GL0 is supplied with a dummy scan pulse Vout0, wherein the dummy scan pulse Vout0 is output in first among the scan pulses output during each frame period. Accordingly, the dummy gate line GL0 is driven first during in each frame period.

For the period just prior to the display period of supplying the data to the first and second pixel cells PXL1 and PXL2, the pre-charging unit 500 previously shifts the polarity of data charged in the first and second pixel cells PXL1 and PXL2 to the polarity direction of data to be supplied for the display period. Thus, it is possible to induce the polarity of data charged in the first and second pixel cells PXL1 and PXL2 to transition toward the polarity direction of data to be supplied for the display period. An example operation of the pre-charging unit 550 to control the first and second pixel cells PXL1 and PXL2 of the third pixel row L3 and the connection relation between the first and second pixel cells PXL1 and PXL2 will be explained in detail hereinafter.

The pre-charging unit 550 positioned at the leftmost side of the third pixel row L3 is connected between the first pixel cell PXL1 connected to the sixth gate line GL6 and the first data line DL1 and the second pixel cell PXL2 connected to the fifth gate line GL5 and the second data line DL2.

As shown in FIGS. 5 and 6, the second pixel cell PXL2 is supplied with the negative polarity data for the fifth period T5, and the first pixel cell PXL1 is supplied with the positive polarity data for the sixth period T6. That is, the fifth period T5 corresponds to the display period of the second pixel cell PXL2, and the sixth period T6 corresponds to the display period of the first pixel cell PXL1. For the period just prior to the display period, the second pixel cell PXL2 maintains the positive polarity data supplied for the previous frame period, and the first pixel cell PXL1 maintains the negative polarity data supplied for the previous frame period. That is, the data of the second pixel cell PXL2 transitions from the positive polarity to the negative polarity for the fifth period T5, and the data of the first pixel cell PXL1 transitions from the negative polarity to the positive polarity for the sixth period T6.

For the period just prior to the fifth period T5, that is, fourth period T4, the fourth scan pulse Vout4 is supplied to the fourth gate line GL4 (positioned at the lower side of the second pixel row L2). In response to the fourth scan pulse Vout4, the pre-charging unit 440 is turned-on. Through the pre-charging unit 550 being turned-on, the pixel electrode PE of the first pixel cell PXL1 is electrically connected to the pixel electrode PE of the second pixel cell PXL2.

For the fourth period T4, the negative polarity data of the first pixel cell PXL1 is mixed with the positive polarity data of the second pixel cell PXL2. For the fourth period T4, the first pixel cell PXL1 is sustained with the negative polarity data, and the second pixel cell PXL2 is sustained with the positive polarity data. Accordingly, the positive polarity data of the second pixel cell PXL2 is affected by the negative polarity data of the first pixel cell, and the negative polarity data of the first pixel cell PXL1 is affected by the positive polarity data of the second pixel cell PXL2.

When the first and second pixel cells PXL1 and PXL2 are charged with the opposite polarities, and are electrically connected to each other, the data of the pixel cell rises or falls toward the central voltage corresponding to the common voltage Vcom. In particular, the negative polarity data charged in the first pixel cell PXL1 is affected by the positive polarity data from the second pixel cell PXL2, whereby the voltage rises toward the common voltage. Meanwhile, the positive polarity data charged in the second pixel cell PXL2 is affected by the negative polarity data from the first pixel cell PXL1, whereby the voltage falls toward the common voltage Vcom.

For the fifth period T5, the fifth scan pulse Vout5 is supplied to the fifth gate line GL5, and the scan pulse is not supplied to the fourth gate line GL4. Accordingly, the pre-charging unit 550 is turned-off for the fifth period T5, so that the first pixel cell PXL1 is electrically disconnected from the second pixel cell PXL2.

The fifth period T5 corresponds to the display period of the second pixel cell PXL2 connected to the fifth gate line GL5 and the second data line DL2. For the fifth period T5, the second data line DL2 is supplied with the negative polarity data. Accordingly, the second pixel cell PXL2 is supplied with the negative polarity data.

At this time, since the positive polarity data charged in the second pixel cell PXL2 previously fell toward the common voltage Vcom at the fourth period T4, the negative polarity data charged in the second pixel cell PXL2 is rapidly changed to the positive polarity data supplied at the fifth period T5.

After that, for the sixth period T6, the sixth scan pulse is supplied to the sixth gate line GL6, and is not supplied to the fourth gate line GL4. Accordingly, the pre-charging unit 550 is turned-off for the sixth period T6, whereby the first pixel cell PXL1 is electrically disconnected from the second pixel cell PXL2.

The sixth period T6 corresponds to the display period of the first pixel cell PXL1 connected to the sixth gate line GL6 and the first data line DL1. For the sixth period T6, the positive polarity data is supplied to the first data line DL1. Accordingly, the first pixel cell PXL1 is supplied with the positive polarity data.

Because the negative polarity data charged in the first pixel cell PXL1 previously rose toward the common voltage Vcom at the fourth period T4, the negative polarity data charged in the first pixel cell PXL1 is rapidly changed to the positive polarity data supplied at the sixth period T6.

As described above, the liquid crystal display device according to the present invention and the method of driving the same have the following advantages.

The liquid crystal display device according to the present invention includes the pre-charging unit that induces a rapid change for the polarity of data charged in the first and second pixel cells toward the polarity direction of data supplied for the display period by previously shifting the magnitude of data charged in the first and second pixel cells toward the polarity direction of data supplied for the period just prior to the display period of supplying the data to the first and second pixel cells, thereby improving the charging of pixel cell.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal panel including a plurality of first and second pixel cells supplied with data of the opposite polarities to display a picture; and at least one pre-charging unit to electrically connect a first one of the first pixel cells and a first one of the second pixel cells to each other just prior to a period of supplying the data to the first ones of the first and second pixel cells, and to electrically disconnect the first ones of the first and second pixel cells from each other for a period of supplying the data to the first and second pixel cells;

a data driver supplying alternately a positive polarity data and a negative polarity data to data lines every two periods;

a dummy gate line firstly driven in each frame period;

wherein the liquid crystal panel includes a plurality of gate and data lines, wherein the gate lines cross the data lines;

wherein the first one of first pixel cells is positioned at one side of an odd-numbered data line of the data lines, a second one of first pixel cells is positioned at the other side of the odd-numbered data line, and the first and second ones of the first pixel cells are connected to the odd-numbered data line in common, wherein the first one of second pixel cells is positioned at one side of an even-numbered data line of the data lines, a second one of second pixel cells is positioned at the other side of the even-numbered data line, and the first and second ones of the second pixel cells are connected to the even-numbered data line in common, wherein the first pixel cell positioned at one side of the odd-numbered data line and the second pixel cell positioned at one side of the even-numbered data line are connected to a first gate line of the gate lines in common, and wherein the first pixel cell positioned at the other side of the odd-numbered data line and the second pixel cell positioned at the other side of the even-numbered data line are connected to a second gate line of the gate lines in common;

wherein a first pre-charging unit among pre-charging units is positioned in a first pixel row;

wherein the first pre-charging unit positioned in the first pixel row is controlled by the dummy gate line.

2. The liquid crystal display device of claim 1, wherein the pre-charging unit electrically connects the pixel electrode of the first pixel cell to the pixel electrode of the second pixel cell for the active state of the scan pulse in response to the scan pulse from a third gate line, the third gate line previously driven prior to driving the first and second gate lines.

3. The liquid crystal display device of claim 2, wherein the pre-charging unit includes a switching device which is controlled by the scan pulse from the third gate line, and is connected between the pixel electrode of the first pixel cell and the pixel electrode of the second pixel cell.

* * * * *